US011662083B2

(12) United States Patent
Steele

(10) Patent No.: US 11,662,083 B2
(45) Date of Patent: May 30, 2023

(54) MODULAR OUTDOOR LIGHT FIXTURE AND ACCESSORIES

(71) Applicant: Adam Steele, Tabernacle, NJ (US)

(72) Inventor: Adam Steele, Tabernacle, NJ (US)

( * ) Notice: Subject to any disclaimer, the term of this patent is extended or adjusted under 35 U.S.C. 154(b) by 0 days.

(21) Appl. No.: 17/719,650

(22) Filed: Apr. 13, 2022

(65) Prior Publication Data

US 2022/0235920 A1 Jul. 28, 2022

Related U.S. Application Data

(63) Continuation of application No. 16/003,905, filed on Jun. 8, 2018, now Pat. No. 11,333,329.

(60) Provisional application No. 62/565,301, filed on Sep. 29, 2017.

(51) Int. Cl.

| | |
|---|---|
| ***F21V 17/12*** | (2006.01) |
| ***F21V 3/02*** | (2006.01) |
| ***F21V 17/06*** | (2006.01) |
| ***F21V 15/01*** | (2006.01) |
| ***F21V 31/00*** | (2006.01) |
| ***F21V 13/10*** | (2006.01) |
| ***F21S 8/08*** | (2006.01) |
| ***H01R 33/46*** | (2006.01) |
| ***H01R 33/94*** | (2006.01) |
| ***F21V 23/06*** | (2006.01) |
| *F21W 131/10* | (2006.01) |

(52) U.S. Cl.

CPC ..... *F21V 17/12* (2013.01); *F21S 8/081* (2013.01); *F21V 3/02* (2013.01); *F21V 13/10* (2013.01); *F21V 15/01* (2013.01); *F21V 17/06* (2013.01); *F21V 23/06* (2013.01); *F21V 31/005* (2013.01); *H01R 33/46* (2013.01); *H01R 33/94* (2013.01); *F21W 2131/10* (2013.01)

(58) Field of Classification Search

CPC ..... H01R 33/46; F21V 17/06; F21V 15/01; F21V 3/02; F21V 23/06; F21V 13/10; F21S 8/081; F21W 2131/10

See application file for complete search history.

(56) References Cited

U.S. PATENT DOCUMENTS 5,414,607 A * 5/1995 Harris ..... F21V 23/00 362/431
6,135,623 A * 10/2000 Lin ..... F21V 17/14 362/431

(Continued)

*Primary Examiner* — Tracie Y Green
(74) *Attorney, Agent, or Firm* — Argus Intellectual Enterprise; Daniel Enea; Jordan Sworen

(57) ABSTRACT

Provided is a modular light fixture. The device includes a light shroud, a light fixture base having a first cylindrical housing, a second cylindrical housing, a quick disconnect with a pair of external pins, and a light fixture base supporting attachment that includes a pair of P-shaped channels. The shroud attaches to the first cylindrical housing, and the base attachment attaches to the base via the P-shaped channels and the first and second external pins. The shroud and base attachments can be interchanged as desired for use as a hanging light, an up light, a down light, a well light, a path light, a wash light, or any combination thereof. The device allows for quick and easy conversion of lights from one style to another without requiring an entirely new fixture, enables simple repairs, and lessens the number of items required to be stocked by an installer.

20 Claims, 9 Drawing Sheets

(56) References Cited

U.S. PATENT DOCUMENTS

| | | | | |
|---|---|---|---|---|
| 7,036,960 | B1 * | 5/2006 | Gretz | F21V 11/02 362/279 |
| 11,333,329 | B2 * | 5/2022 | Steele | H01R 33/46 |
| 2015/0092405 | A1 * | 4/2015 | Shumate | F21V 21/116 362/230 |

* cited by examiner

MODULAR OUTDOOR LIGHT FIXTURE AND ACCESSORIES

CROSS REFERENCE TO RELATED APPLICATION

This application claims the benefit of pending U.S. Non-provisional application Ser. No. 16/003,905 filed on Jun. 8, 2018, and U.S. Provisional Application No. 62/565,301 filed on Sep. 29, 2017, the above identified patent application is herein incorporated by reference in its entirety.

BACKGROUND OF THE INVENTION

1. Field of the Invention

The present invention relates to outdoor lights. More particularly, the present invention pertains to a modular outdoor light fixture comprising a light fixture base with a plurality of light shrouds and base attachments that attach to the base via a quick disconnect mechanism.

Decorative outdoor lighting elements are commonly found in both residential and commercial applications to enhance the appearance of a property. As an example, outdoor lights are used to outline a walkway, illuminate a structure or dwelling, and to provide an aesthetically pleasing dimension to a location. As can be appreciated, a variety of lighting elements are known and available for enhancing the appearance of a location. Additionally, outdoor lights are also used to increase safety by illuminating walkways, driveways, and other obstacles that are not readily visible in dark and lowlight conditions.

A variety of lighting elements having different design features are known and used in the art. These elements are selected for use based on the area to be illuminated. A non-exhaustive list of commonly used outdoor lighting elements includes hanging lights, up lights, down lights, well lights, path lights, and wash lights. Each of these lighting elements are generally designed for use as a stand-alone product, and do not include a means for converting from one type of light to another. The lack of convertibility means that a consumer is required to replace an entire light fixture or element if a part of it is damaged, or if it is desirable to change from one light type to another, such as, for example, from an up light to a path light. Additionally, light installers are required to carry each type of lighting product in their inventory, which can be prohibitively expensive.

The present invention overcomes the problems inherent in conventional outdoor lighting elements by providing a modular light fixture. The device comprises a light shroud, a light fixture base having a first cylindrical housing, a second cylindrical housing, a quick disconnect with a pair of external pins, and a light fixture base supporting attachment that includes a pair of P-shaped channels. The shroud attaches to the first cylindrical housing, and the base attachment attaches to the base via the P-shaped channels and the first and second external pins. The shroud and base attachments can be interchanged as desired for use as a hanging light, an up light, a down light, a well light, a path light, a wash light, or any combination thereof. The device allows for quick and easy conversion of lights from one style to another without requiring an entirely new fixture, enables simple repairs, and lessens the number of items required to be stocked by an installer.

2. Description of the Prior Art

Devices have been disclosed in the prior art that relate to modular light fixtures. These include devices that have been patented and published in patent application publications. These devices generally relate to modular light fixtures for outdoor lighting. The following is a list of devices deemed most relevant to the present disclosure, which are herein described for the purposes of highlighting and differentiating the unique aspects of the present invention, and further highlighting the drawbacks existing in the prior art.

U.S. Pat. No. 7,063,553 B1 (MULLEN) discloses a quick release socket and a quick release base. The quick release socket includes a housing, a light bulb attachment, and two electrical contact posts on the bottom surface of the housing. The quick release base includes two electrical connection slots. The outside of the bottom surface possesses two electrical input posts. Inside the housing, the two electrical connection slots are electrically connected to the two electrical input posts. The two electrical contact posts of the quick release socket and the two electrical contact slots of the quick release base are designed to engage each other and lock together following insertion and rotation of the quick release socket in the quick release base. The quick release socket and the quick release base lock together by rotating the socket with respect to the base.

US 2008/0151545 A1 (Brija) discloses an outdoor decorative lighting arrangement and system that includes a lighting fixture comprising a stake, a bulb and shade assembly, and a coupling configuration providing for the attachment and detachment of the bulb and shade assembly to the stake. The shades are also detachable and interchangeable on the lighting fixtures and come in a variety of forms or shapes representing various events, seasons, and holidays, and the shades can incorporate solar panels as the energy source that illuminates the bulbs. The stakes and the bulb and shade assemblies also include quick connect/disconnect interior plugs.

U.S. Pat. No. 7,938,565 B2 (Richard) discloses a lighting assembly and apparatus having a light fixture mounted using a tube and stake assembly, wherein the tube is configured with a male receptacle formed of a pronged plug positioned vertically with the upper end flush with the earth. The stake is configured with a female receptacle containing electrical contacts adapted to receive the pronged plug of the male receptacle. The female receptacle is adapted to have an open end so as to clear debris to the bottom of said stake.

US 2014/0119022 A1 (Beausoleil) discloses a landscape lighting system that includes a plurality of interchangeable light diverting elements adapted to be secured over the LED. Each of the light diverting elements has a unique light diversion angle associated therewith, whereby only one of the light diverting elements is secured over the LED at any one time. The landscape lighting system includes a light intensity controller in communication with the LED driver. The light intensity controller includes a control element that enables an operator to selectively increase and decrease the intensity of the light generated by the LED.

As can be seen from the above, there is currently no device that includes a light fixture base with a plurality of light shrouds and base attachments that attach to the base via P-shaped channels and first and second external pins.

SUMMARY OF THE INVENTION

The present invention overcomes the problems inherent in conventional outdoor lighting elements by providing a modular light fixture. The device comprises a light shroud, a light fixture base having a first cylindrical housing, a second cylindrical housing, a quick disconnect with a pair of external pins, and a light fixture base supporting attachment that includes a pair of P-shaped channels. The shroud attaches to the first cylindrical housing, and the base attachment attaches to the base via the P-shaped channels and the first and second external pins. The shroud and base attachments can be interchanged as desired for use as a hanging light, an up light, a down light, a well light, a path light, a wash light, or any combination thereof. The device allows for quick and easy conversion of lights from one style to another without requiring an entirely new fixture, enables simple repairs, and lessens the number of items required to be stocked by an installer.

The present invention substantially diverges in design elements from the prior art and consequently it is clear that there is a need in the art for an improvement to modular light fixture devices. In this regard the instant invention substantially fulfills these needs.

Objects of the Invention

In view of the foregoing disadvantages inherent in the known types of modular light fixtures now present in the prior art, the present invention provides a new modular light fixture wherein the same can be utilized for quick and easy conversion of lights from one style to another without requiring an entirely new fixture.

It is therefore an object of the present invention to provide a new and improved modular light fixture device that has all of the advantages of the prior art and none of the disadvantages.

It is another object of the present invention to provide a modular light fixture device that allows for quick and easy conversion of lights from one style to another without requiring an entirely new fixture.

Yet another object of the present invention is to provide a modular light fixture device that includes a means for quickly attaching and detaching light shrouds of varying style.

Another object of the present invention is to provide a modular light fixture device having a light fixture base with a quick disconnect for quickly attaching and detaching light fixture base supporting attachments.

Yet another object of the present invention is to provide a modular light fixture device having shroud and base attachments that can be interchanged as desired for use as a hanging light, an up light, a down light, a well light, a path light, a wash light, or any combination thereof. The modular light fixture device may be readily fabricated from materials that permit relative economy and are commensurate with durability. Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
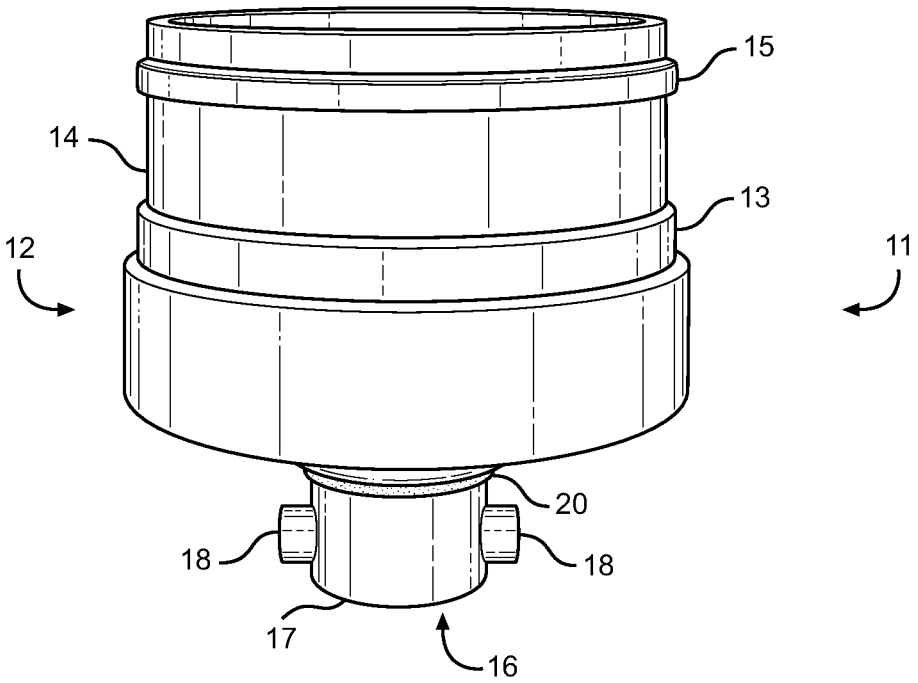
FIG. 1 shows a side view of the light fixture base.

Reference is made herein to the attached drawings. Like reference numerals are used throughout the drawings to depict like or similar elements of the modular light fixture device. For the purposes of presenting a brief and clear description of the present invention, the preferred embodiment will be discussed as used as an outdoor light fixture comprising a plurality of accessory components. The figures are intended for representative purposes only and should not be considered to be limiting in any respect.

Referring now to FIG. 1, there is shown a side view of the light fixture base 11. The light fixture base 11 comprises a first cylindrical housing 12, a light shroud retaining lip 13, a first cylindrical base extension 14, and a light shroud weather seal 15. The lower portion of the fixture base 11 further comprises a second cylindrical housing 16, a second cylindrical base extension 17, and a quick disconnect comprising a pair of external pins 18, and a spacer 20. The interior of the fixture base 11 includes components (not shown) to illuminate a lightbulb when connected to a standard power source. Such components are known and well understood in the art. As will be shown below, the light fixture base 11 is designed to accept a light shroud and a light fixture base attachment.

Figure 2:
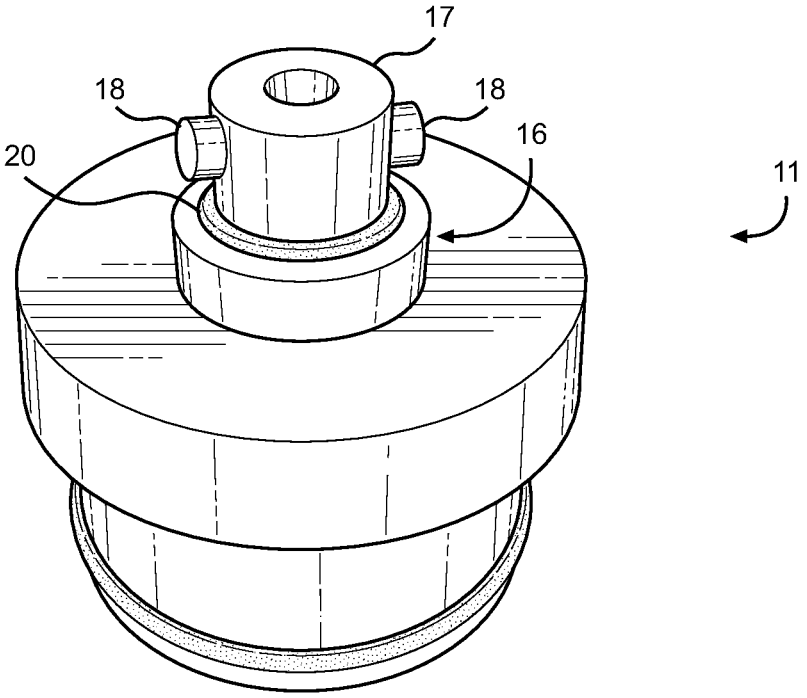
FIG. 2 shows a perspective view of the lower side of the light fixture base.

Referring now to FIG. 2, there is shown a perspective view of the lower side of the light fixture base 11. The lower portion of the fixture base 11 includes a second cylindrical housing 16, a second cylindrical base extension 17, and a quick disconnect comprising a pair of external pins 18, and a spacer 20. The external pins 18 mate with a plurality of base supporting attachments, which will be shown in greater detail below. The base supporting attachments attach to the base 11 with a twist-lock friction fit mechanism, enabling the attachments to be quickly added or removed as desired. The various attachments enable a single light fixture base 11 to be used in a variety of outdoor lighting applications. A non-exhaustive list of light types that can be created with the light fixture base 11 include a hanging light, an up light, a down light, a well light, a path light, and/or a wash light. As can be appreciated, the base 11 and the attachments/accessories can be interchanged to convert the light from one type to another, such as, for example, from a hanging light to a path light.

Figure 3A:
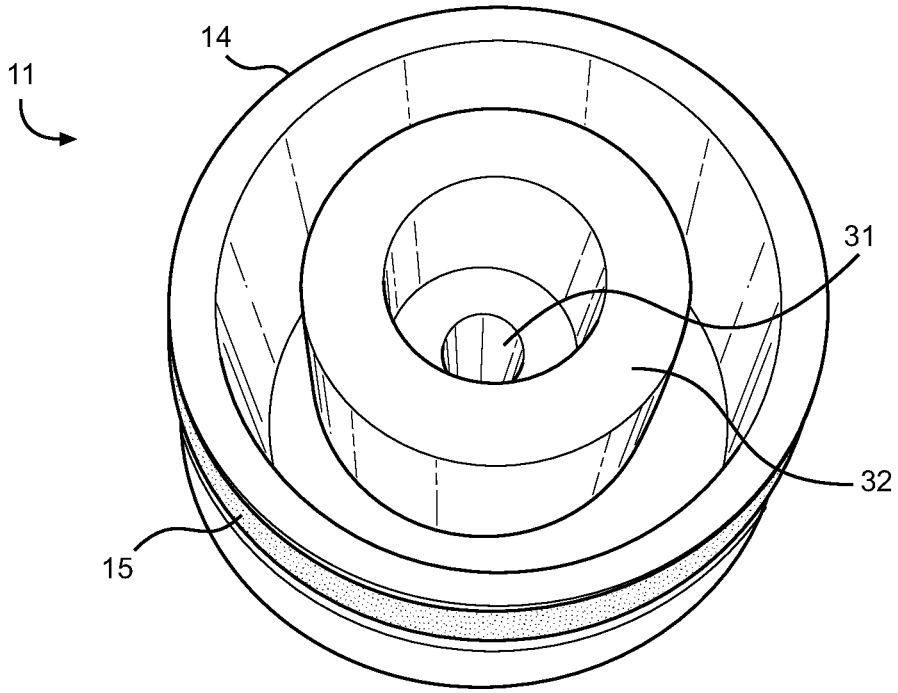
FIG. 3A shows an overhead view of the light fixture base.

Referring now to FIG. 3A, there is shown a perspective overhead view of the light fixture base 11. The interior of the base 11 comprises an interior member 32 and an exterior member. In some embodiments, the interior member 32 and the exterior member form inner circle and outer circles. The outer circle is formed by the first cylindrical base extension 14. The inner circle 32 is designed to support a conventional lightbulb. Also visible in this view is the channel 31 that extends through the first cylindrical base extension 14 to enable wires and other components to be fitted into the base 11. The first cylindrical base extension 14 and light shroud weather seal 15 are designed to enable friction fitting of a shroud or lens covers, which will be discussed in further detail below.

Figure 3B:
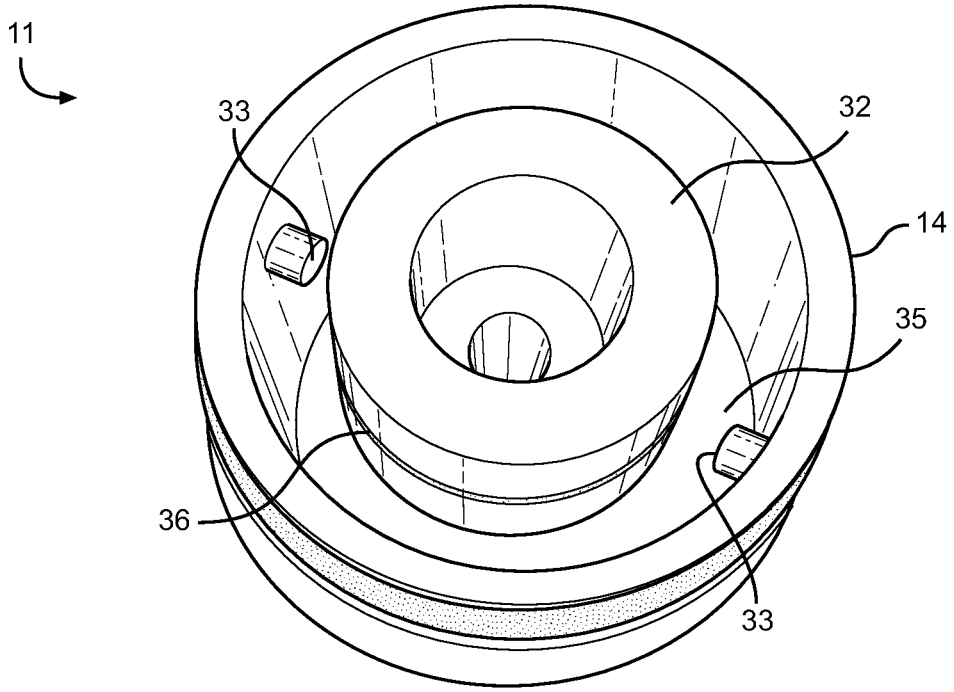
FIG. 3B shows an alternate embodiment of the light fixture base with a pair of internal pins.

Referring now to FIG. 3B, there is shown a perspective overhead view of an alternate embodiment of the light fixture base 11 with a pair of internal pins 33. The upper portion of the base 11 includes a pair of internal pins 33 that are designed to mate with a plurality of shrouds or lens covers via a twist-lock friction fit mechanism. The shroud/lens is designed to friction fit inside the first cylindrical base extension 14 of the base 11, and to rest on the shroud floor 35. As will be shown in greater detail below, the shroud/lens cover includes a pair of notches for mating with the internal pins 33, wherein the shroud/lens is twisted in such a manner as to lock the shroud/lens to the pins 33, thereby preventing it from being inadvertently removed.

Figure 4:
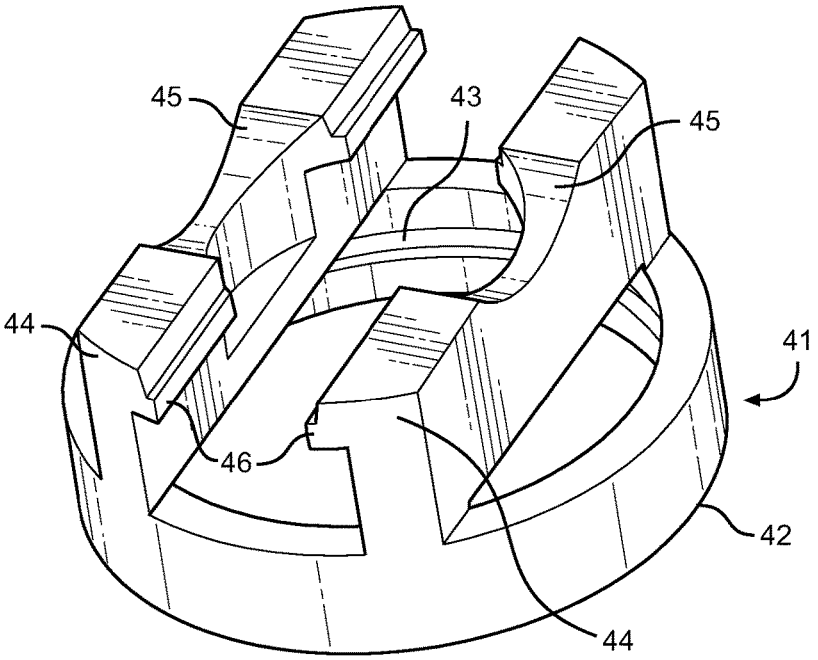
FIG. 4 shows a perspective view of the light bulb adapter.

Referring now to FIG. 4, there is shown a perspective view of the light bulb adapter 41. The light bulb adapter 41 mates with the inner circle 32 as shown in FIG. 3B via an outer snap ring 42. The outer snap ring 42 comprises a female channel 43 that mates with a male channel 36 on the inner circle 32, as shown in FIG. 3B. When pressed together, the light bulb adapter 41 snaps onto the inner circle 32 and is retained securely in position. The light bulb adapter 41 further includes a pair of bulb holding arms 44 that are adapted to hold a variety of outdoor light bulbs. As can be appreciated, conventional outdoor light fixtures are designed to accept one standard type of base, for example a G-4. This means that a completely different base is required for applications where a bulb having a different base, such as a MR-16 base is desirable. The light bulb adapter 41 of the present invention overcomes this limitation by enabling use of a single base with bulbs having different bases, such as MR-16, G-4, MR-8, or MR-11 bases.

The light bulb adapter 41 further includes a pair of indentations 45 in the bulb holding arms 44 that enable a user to insert and remove a bulb (not shown) as desired. The arms 44 further include two sets of shelves 46 that aid in holding the bulb in position. The bulb rests between the bulb holding arms 44 to allow the anode and cathode leads to make contact with the socket within the base 11, such that when electrical energy is applied to the base bulb holding arms 44, the bulb is illuminated.

Figure 5:
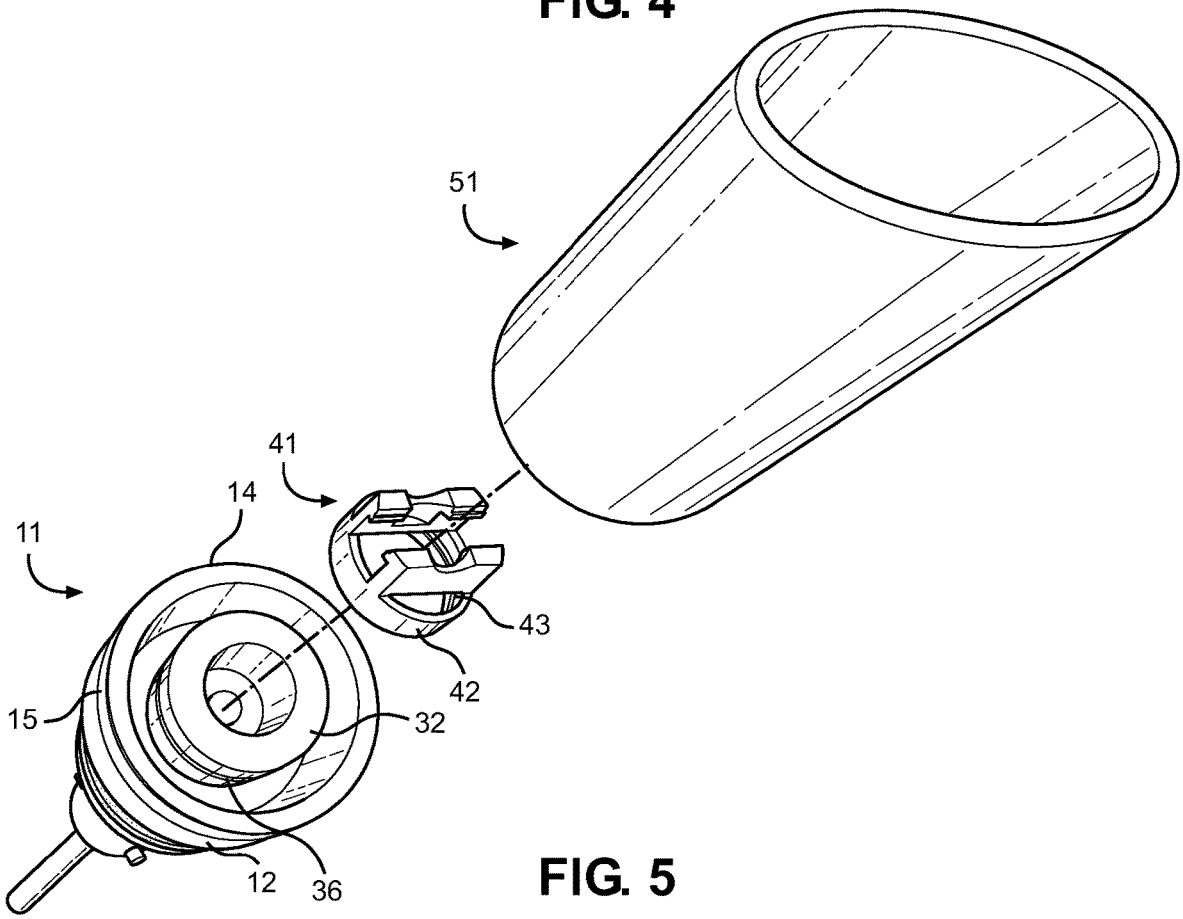
FIG. 5 shows an exploded view of the light fixture base, light bulb adapter, and shroud/lens cover.

Referring now to FIG. 5, there is shown an exploded view of the light fixture base 11, light bulb adapter 41, and shroud 51. As a non-limiting example of how the components of the present invention work together to create a modular lighting assembly, a base 11, adapter 41, and cover 51 are shown. As described above, the light bulb adapter 41 comprises an outer snap ring 42 with a female channel 43 that mates with a male channel 36 on the inner circle 32 of the base 11, such that when the components are pressed together, the adapter 41 snaps onto the inner circle 32 and is retained securely in position. The shroud 51 is designed to fit over the light shroud retaining lip 13, a first cylindrical base extension 14, and a light shroud weather seal 15, such that the interior of the shroud 51 is flush with the first cylindrical housing 12 and over the light shroud weather seal 15, and is retained in position via friction. The shroud 51 is pressed onto the base 11 until the shroud 51 makes contact with the light shroud base 11 and is flush with the first cylindrical housing 12.

Figure 6:
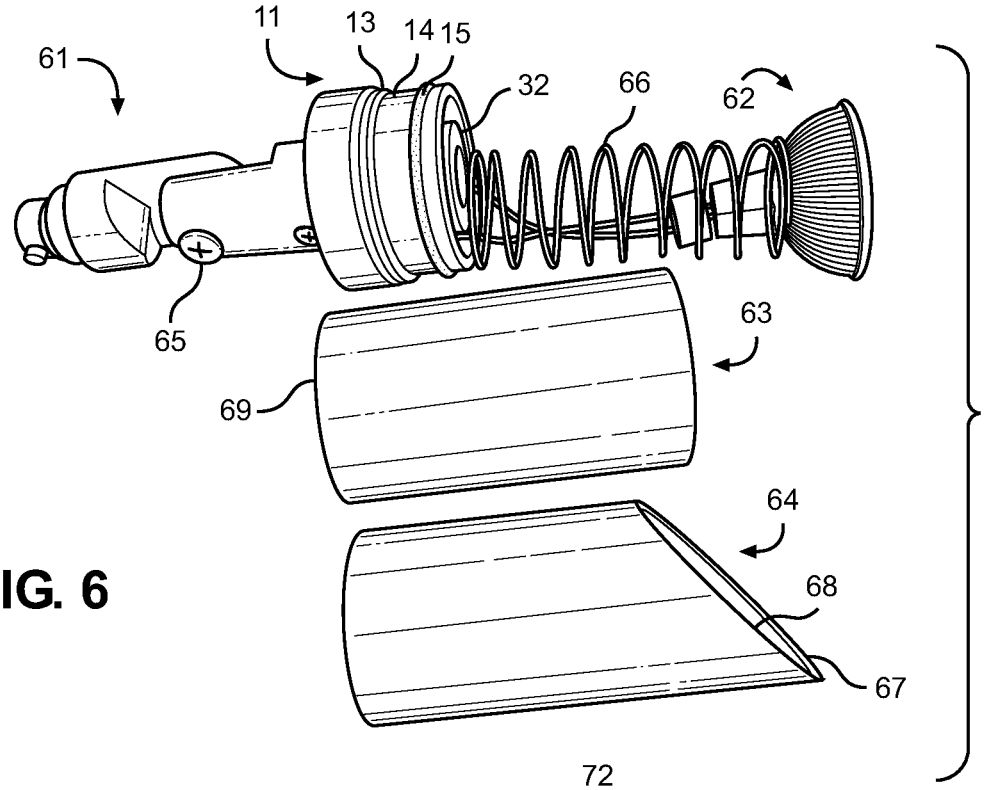
FIG. 6 shows an exploded view of the light fixture base, a quick disconnect pivot elbow, a conventional light bulb, and various shrouds.

Referring now to FIG. 6, there is shown an exploded view of the light fixture base 11, a quick disconnect pivot elbow 61, a conventional light bulb 62, and various shrouds 63, 64. The light fixture base 11 is designed to accept a plurality of light fixture base attachments on a first end, and a plurality of shroud/lens covers on a second end. As a non-limiting example, the base 11 can be utilized with a quick disconnect pivot elbow 61. The elbow 61 enables a user to quickly adjust the direction of the light with a screw 65 that can be loosed to make adjustments and tightened to secure the device in position. In place of the light bulb adapter 41 as shown in FIG. 4, the inner circle 32 can be constructed in a size that retains the light bulb 62 in place when installed therein. The spring 66 applies pressure between the bulb 62 and the base 11 for ease of removal.

The removable shroud enables the base 11 to be used in a variety of lighting applications. As non-limiting examples, the base 11 can accept a directional/up light shroud 64 or an area/path light shroud 63. Examples of other shroud types include a wall wash light or a top mounted reflector. As can be appreciated, the directional/up light 64 includes an opaque cylinder with an angled top 67 and a diffuser 68. In this application, light travels through the diffuser 68 and the angled top 67 to illuminate the desired area. The area/path light shroud 63 can include a solid top and cylinder 69, and is preferably constructed of a transparent, semitransparent, or translucent material. In this application, light travels through the transparent, semitransparent, or translucent portion of the shroud to provide illumination. Alternately, the cylinder 69 can be constructed of a transparent, semitransparent, or translucent material. In this application, light travels through all sides of the shroud 63 to illuminate the desired area. Regardless of design, each shroud 63, 64 are designed to fit over the light shroud retaining lip 13, first cylindrical base extension 14, and a light shroud weather seal 15, such that the interior of the shroud 63, 64 rests against the light shroud retaining lip 13, and light shroud weather seal 15, and is retained in position via friction.

Alternatively, the shrouds 63, 64 can be constructed with a pair of lower channels for attachment to the internal pins, as described below.

Figure 7:
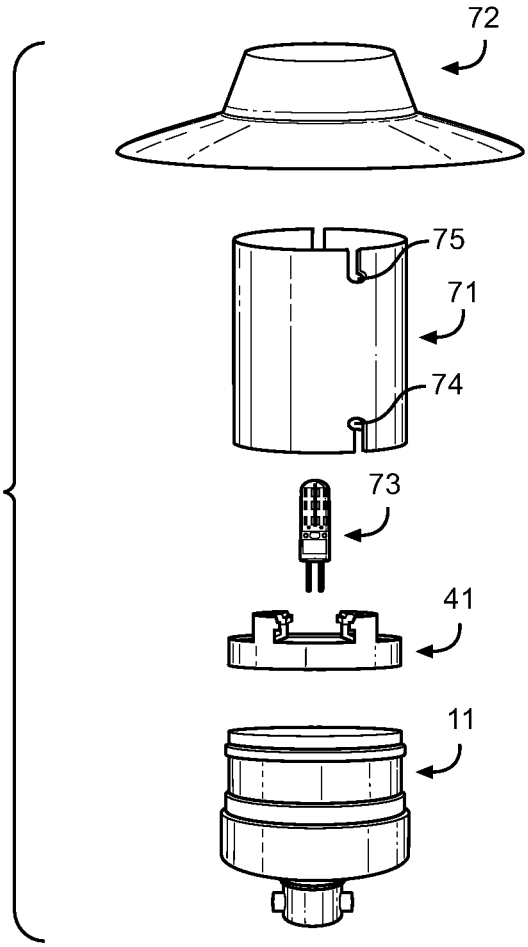
FIG. 7 shows an exploded view of a shroud, a top mounted reflector, a light bulb, a light bulb adapter, and a light fixture base.

Referring now to FIG. 7, there is shown an exploded view of a shroud 71, a top mounted reflector 72, a light bulb 73, a light bulb adapter 41, and a light fixture base 11. In this embodiment, the shroud 71 attaches to the base 11 via a pair of lower channels 74 that mate with the pins 33 as shown in FIG. 3B within the base 11. In this application, the shroud 71 additionally includes a pair of upper channels 75 that mate with a pair of internal pins (not shown) on the interior of the top mounted reflector 72. The addition of the upper channels 75 enables a user to quickly change reflectors, thereby providing for an easy means of altering the aesthetics of the light. As can be appreciated, a user can remove and add various reflectors to decorate for holidays or to direct lighting from one area to another. Alternatively, the shroud 71 can be constructed without the lower channels 74 and can be used in a friction fit matter as described above.

Figure 8:
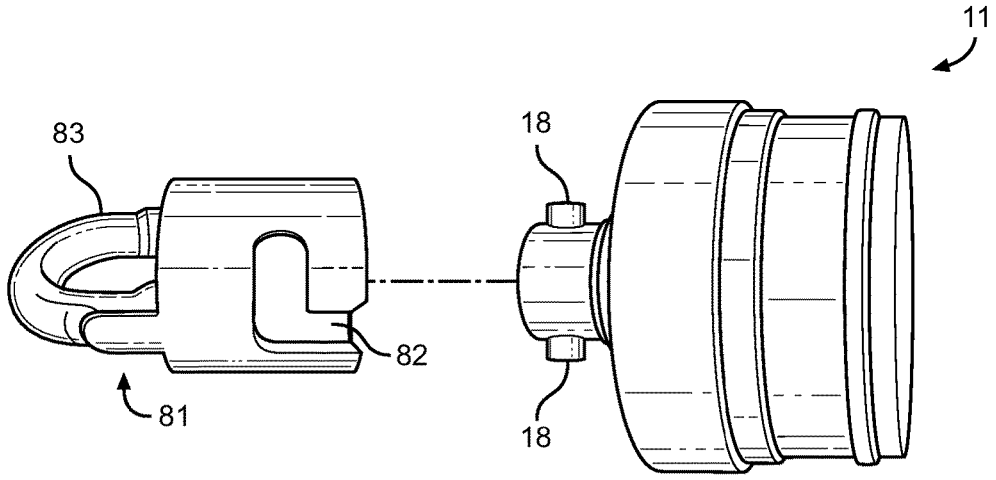
FIG. 8 shows a close-up view of a quick disconnect hanger and the light fixture base.

Referring now to FIG. 8, there is shown a close-up view of a quick disconnect hanger 81 and a light fixture base 11. In this embodiment, the device is designed to function as a conventional outdoor hanging light, which is well known and understood in the art. As shown, the base 11 functions with a quick disconnect hanger 81, and attaches to the external pins 18 via a pair of slots 82 in the hanger 81. In the preferred embodiment, the slots 82 comprise a P-shaped channel. The hanger 81 attaches to the base 11 with a twist-lock mechanism, enabling the hanger 81 to be quickly added or removed as desired. The loop 83 on the hanger 81 enables the device to be quickly attached and detached from any desired location. As can be appreciated, the loop 83 can be solid, or can open and close via a spring mechanism.

Figure 9A:
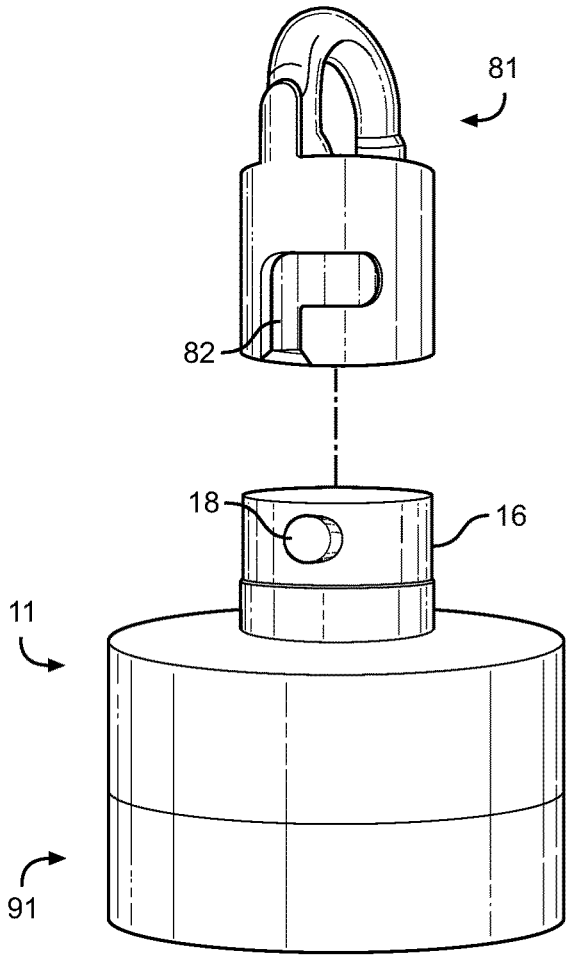
FIG. 9A shows a close-up view of a quick disconnect hanger, a light fixture base, and a lens cover.
Figure 9B:
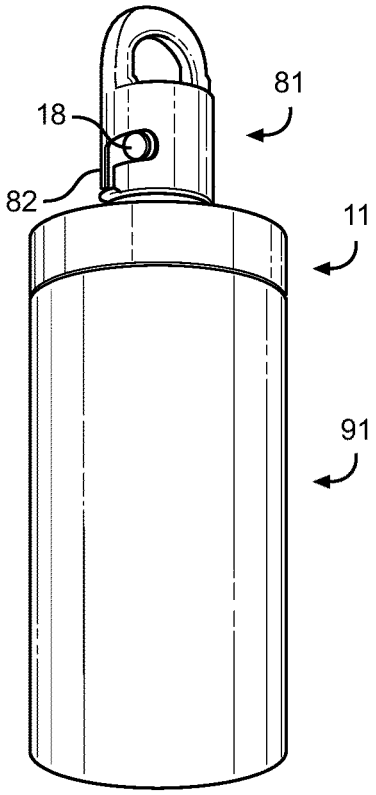
FIG. 9B shows a side view of a quick disconnect hanger, a light fixture base, and a lens cover.

As shown in FIGS. 9A-B, the quick disconnect hanger 81, light fixture base 11, and lens cover 91 are illustrated. As discussed above, the base 11 can be utilized with a quick disconnect hanger 81 to function as a hanging light. The hanger 81 attaches to the external pins 18 as shown in FIG. 8. via a pair of slots 82 in the hanger 81. In the previous examples, the base 11 was oriented such that the first cylindrical housing 12 is oriented upwards and the second cylindrical housing 16 is oriented downward. As shown here, the base 11 can be oriented in any desired direction. The lens cover 91 secures in position over the base 11 as described above in order to provide the desired lighting effect.

Figure 10:
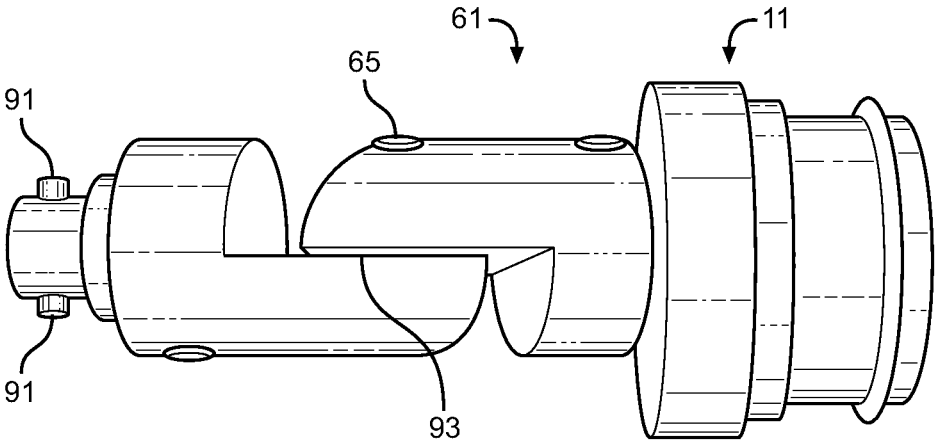
FIG. 10 shows a close-up view of a quick disconnect pivot elbow attached to a light fixture base.
Figure 11A:
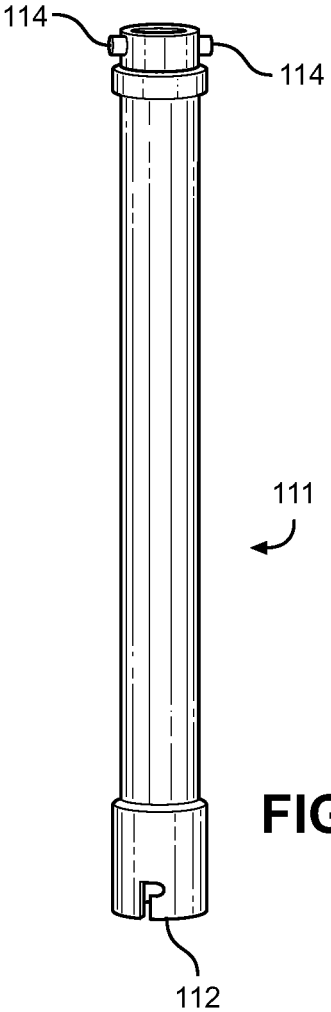
FIG. 11A shows a side view of a quick disconnect riser.
Figure 11B:
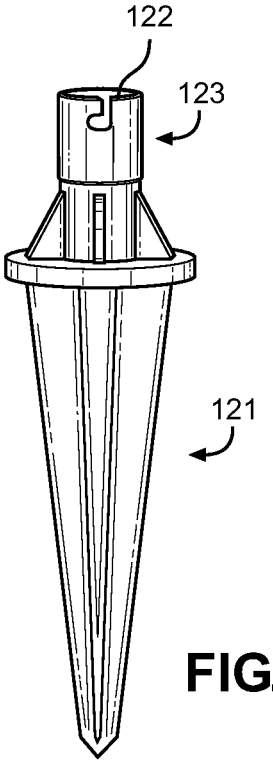
FIG. 11B shows a side view of a quick disconnect ground stake.
Figure 13A:
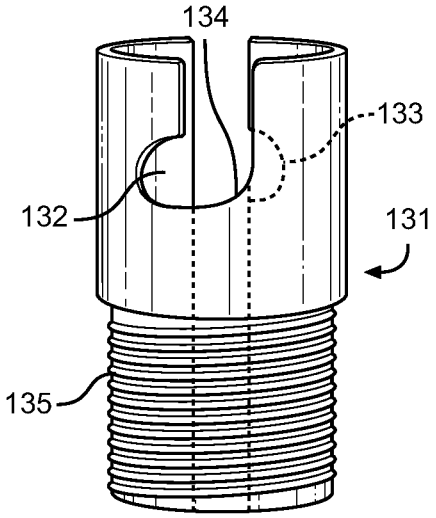
FIG. 13A shows a side view of a slotted quick disconnect.

Referring now to FIG. 10, there is shown a close-up view of a quick disconnect pivot elbow 61 attached to the light fixture base 11. The elbow 61 enables a user to quickly adjust the direction of the light with a screw 65 that can be loosed to make adjustments and tightened to secure the device in position. The end of the elbow 61 that attaches to the base 11 resembles the hanger 81 in FIG. 8 and includes a slot attached to the external pins of the base. The end of the elbow 61 furthest from the base 11 includes a pair of external pins 91. The pins 91 enable the elbow 61 to mate with a variety of attachments. As a non-limiting example, the elbow 61 can mate with a hanger 81 as shown in FIG. 8, a quick disconnect riser 111 as shown in FIG. 11A, a ground stake 121 as shown in FIG. 11B, or a threaded base 131 as shown in FIG. 13A. Alternatively, instead of pins 91, the end of the elbow 61 furthest from the base 11 can include ½" threads that are standardized in the industry.

The elbow 61 includes a pivoting joint 93 that enables the angle of the elbow 61 to be adjusted as desired. The joint 93 can include a threaded adapter, such as a screw 65 that enables the angle of the elbow 61 to be locked in position. Alternately, the joint 93 can include internal teeth that retain the desired angle, a tightening mechanism, or any other means for adjusting the angle thereof. The joint 93 enables a user to quickly adjust the direction of the light, while the screw 65 or teeth/tightening mechanism lock the elbow 61 at the desired angle, which prevents the need for constant readjustment.

Referring now to FIG. 11A, there is shown a side view of a quick disconnect riser 111. The riser 111 is preferably used to increase the height of the light. The riser 111 preferably includes a pair of slots 112 at a first end and a pair of external pins 114 at a second end. As can be appreciated, the slots 112 can mate with the external pins 18 on the base 11 as shown in FIG. 1. The function of the riser 111 is to increase the length of the light system. As a non-limiting example, the riser 111 can mate with a hanger 81 as shown in FIG. 8, a quick disconnect riser 111 as shown in FIG. 11A, a ground stake 121 as shown in FIG. 11B, or a threaded base 131 as shown in FIG. 13A. As can be appreciated, the riser 111 can be constructed in any length that is desirable, preferably from 1 to 24 inches in length. The modularity provided by the riser 111 enables an installer to quickly adjust the height of the light for aesthetics or to ensure proper illumination of an area.

Referring now to FIG. 11B, there is shown a side view of a quick disconnect ground stake 121. The stake 121 includes a pair of slots 122 that provide a means for attaching a light fixture base thereto. The ground stake 121 can be of any desired length and can be constructed from a variety of materials. As can be appreciated, the stake 121 can be inserted into the ground and a base can be attached thereto. The head 123 of the base can be constructed as a solid piece or can be attached via a rotating connection. By enabling rotation of the head 123, a user can position the slots 122 such that an attached light provides illumination in a desired direction or location.

Figure 12:
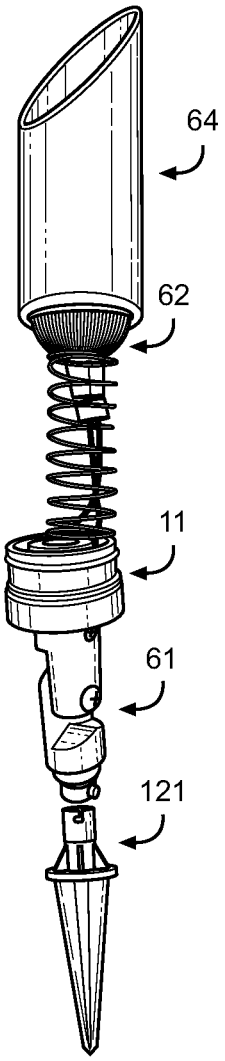
FIG. 12 shows an exploded view of a shroud/lens cover, an attached light, a light fixture base, a quick disconnect pivot elbow, and a ground stake.

Referring now to FIG. 12, there is shown an exploded view of a shroud/lens cover 64, attached light bulb 62, a light fixture base 11, a quick disconnect pivot elbow 61, and a ground stake 121. Shown here is an example of how the various components can be used to create an outdoor light fixture. A directional/up light shroud 64 attaches to the base 11 as described above. The light bulb 62 is secured within the base 11 and between the shroud 64 and base 11. The quick disconnect pivot elbow 61 is attached to the base 11 to enable the shroud 64, light bulb 62, and base 11 to be moved in a desired direction. The final component in this example is the ground stake 121 that enables the light fixture to be installed in the ground. As can be appreciated, any shroud or base component can be used in place of the directional/up light shroud 64 or ground stake 121. Additionally, the light bulb adapter 41 as shown in FIG. 4 can be used in place of the conventional light bulb 62.

Figure 13B:
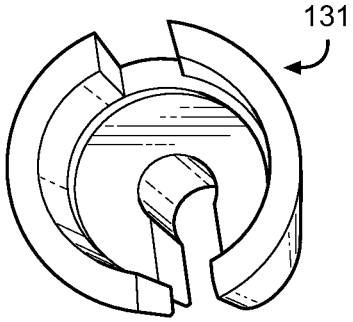
FIG. 13B shows an overhead view of slotted quick disconnect.

Referring now to FIGS. 13A-B, there is shown a side view and an overhead view of a slotted quick disconnect 131. The slotted quick disconnect 131 comprises a pair of slots 132, 133 for attachment to the base 11, as shown in FIG. 1. The slotted disconnect 131 further comprises a slot 134 that extends the length of the disconnect 131. The slot 134 provides an internal channel for running electrical wires, as will be shown below. The disconnect 131 also utilizes ½" male threads 135, which are a standard size in the industry. The base 11 attaches to the disconnect 131 via the slots 132, 133, as described above, while the threads 135 provide for attachment to currently existing brackets and accessories that include ½" female threads. The slotted disconnect 131 provides a simple means of integrating the base 11 and other components of the present invention with existing lighting applications for seamless installation.

Figure 13C:
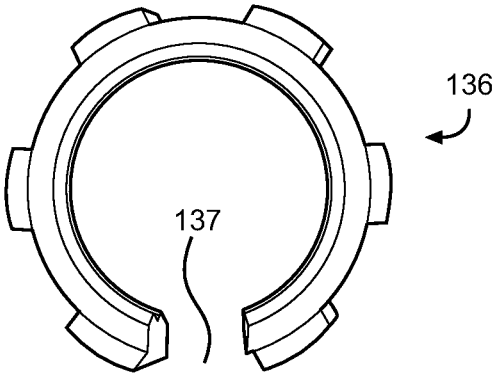
FIG. 13C shows a side view of a slotted locknut.

Referring now to FIG. 13C, there is shown a side view of a slotted locknut 136. The locknut 136 threads onto the male threads 135 of the slotted disconnect 131 as shown in FIGS. 13A-B. The locknut 136 resembles a conventional locknut, but includes a slot 137 for enabling a user to insert or remove wiring from the device. When the locknut 136 is attached to the slotted disconnect 131, the slot 137 is aligned with the slot 134 to create a channel for inserting wiring. The locknut 136 can then be rotated about the threads 135 such that a solid section of the locknut 136 covers the slot 134 to prevent the wiring from being removed.

Figure 14:
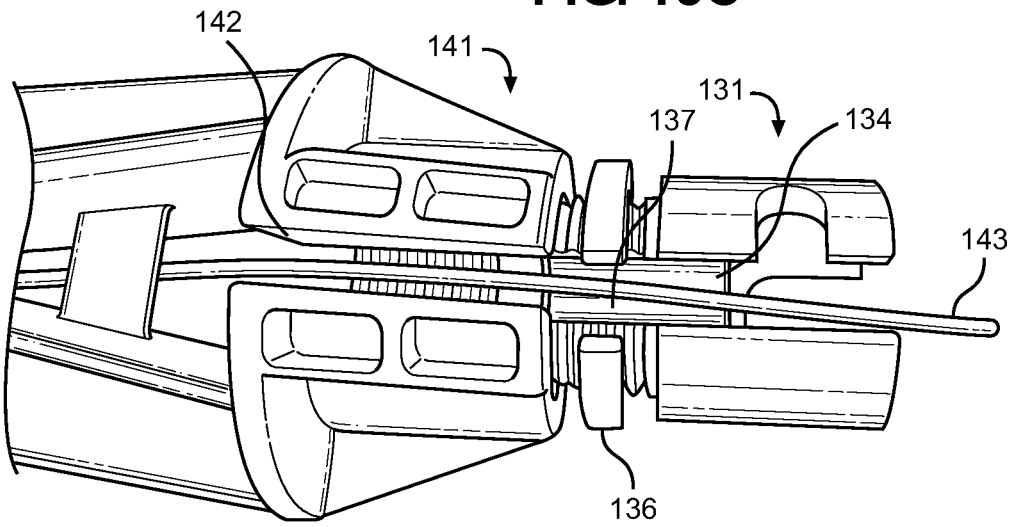
FIG. 14 shows a side view of the slotted disconnect and locknut attached to a prior art threaded ground stake.

Referring now to FIG. 14, there is shown a side view of a slotted disconnect 131 and locknut 136 attached to a prior art threaded ground stake 141. As shown, the slotted disconnect 131 can thread into an existing accessory, such as prior art threaded ground stake 141. The locknut 136 threads between the disconnect 131 and ground stake 141. The slot 134 in the disconnect 131 and the slot 137 in the locknut 136 can be aligned to create a channel 142 that extends from the disconnect 136 to the ground stake 141. The channel 142 enables the insertion or removal of electrical wiring 143 therein. As can be appreciated, the channel 142 protects the wire 143 from exposure to the elements. Once the wire 143 is inserted into the channel 142, the locknut 136 can be rotated so that the slot 137 closes the channel 142 and prevents the wire 143 from being inadvertently removed.

Figure 15A:
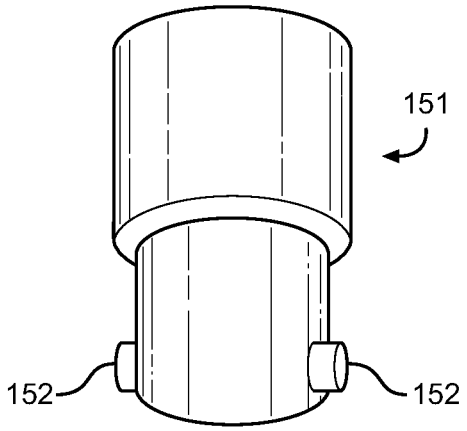
FIG. 15A shows a side view of the female threaded adapter.
Figure 15B:
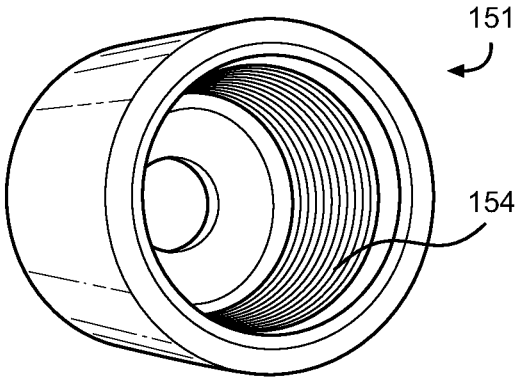
FIG. 15B shows perspective view of the female threaded adapter.

Referring now to FIGS. 15A-B, there is shown a side view and a perspective view of a female threaded adapter 151. The female threaded adapter 151 threads onto any conventional lighting component that is known in the art. The purpose of the adapter 151 is to convert the light component into a quick disconnect, thereby enabling the existing light component to function with the various bases and attachments of the present invention. The adapter 151 utilizes internal or female ½" threads 154 that are standardized throughout the outdoor lighting industry. By using a standard threading, the adapter 151 can be easily attached to or removed from the conventional light. The pins 152 enable the adapter and conventional light fixture to function with the hanger, quick disconnect pivot elbow, ground stake, or any other desired component in the system.

Figure 16A:
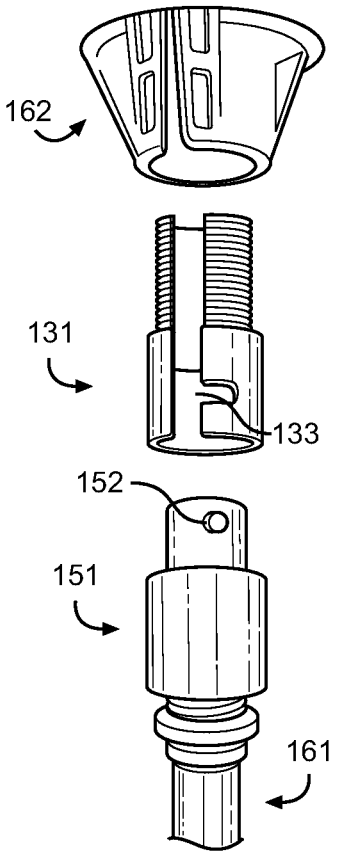
FIG. 16A shows an exploded view of a first prior art accessory, a female threaded adapter, slotted disconnect, and a second prior accessory.
Figure 16B:
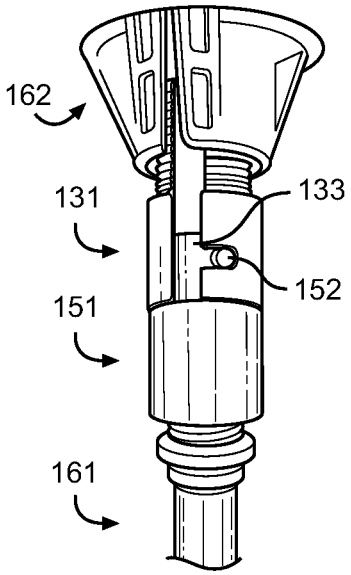
FIG. 16B shows an assembled view of a first prior art accessory, a female threaded adapter, slotted disconnect, and a second prior accessory.

Referring now to FIG. 16A-B, there is shown an exploded view and an assembled view of a first prior art accessory 161, a female threaded adapter 151, slotted quick disconnect 131, and a second prior accessory 162. The female threaded adapter 151 and slotted quick disconnect 131 can be used to convert prior art conventional lighting components into quick disconnects. As shown, the slotted quick disconnect 131 can attach to any prior art accessory having ½" female threads, while the female threaded adapter 151 can be used with any component having ½" male threads. The slot 133 in the slotted disconnect 131 mates with the pins 152 on the female adapter 151 to enable quick assembly and disassembly of the components.

Figure 17:
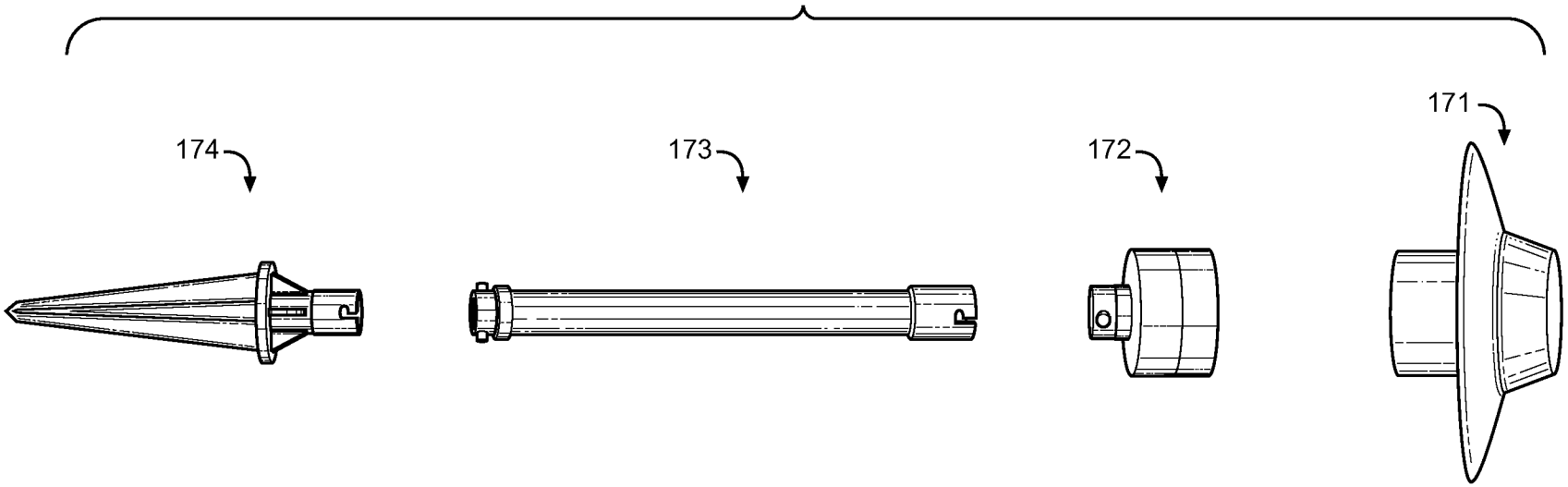
FIG. 17 shows an exploded view of a path light that includes a lens cover and reflector, a light fixture base, a quick disconnect riser, and a ground stake.

Referring now to FIG. 17, there is shown an exploded view of a path light that includes a lens cover and reflector 171, a light fixture base 172, a quick disconnect riser 173, and a ground stake 174. In this example, the light fixture base 172 is utilized with a lens cover and two base supporting attachments. As shown, the lens cover and reflector 171 attach to the base 173 on one end, while the quick disconnect riser 173, and ground stake 174 are attached on the other end. This combination provides additional height to the base 172, which can be advantageous in certain applications. Alternately, a quick disconnect pivot elbow could be substituted for the riser 173, or the base 172 can be attached directly to the ground stake 174.

The modular outdoor light fixture of the present invention is constructed from materials that are adapted to outdoor environmental factors, including sun, water, snow, wind, dirt, and the like. The components of the present invention can be constructed from plastics, PVC material, brass, a low-conductive metal such as aluminum, and/or a combination thereof. The aesthetic features of the present invention can be modified without departing from the spirit or scope of the general inventive concept as defined herein. The components may be round, oval, triangular, square, rectangular, or the like. The components can also be constructed in any desired shape, size, and/or color.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modular light fixture, comprising:

a light fixture base comprising a first base extension at a first end of the light fixture base, the first base extension having an interior member, and a second base housing at a second end of the light fixture base;

the interior member disposed within an exterior member of the first base extension such that a first channel is formed therebetween;

a light bulb adapter is configured to removably couple with the light fixture base at the first end thereof;

the light bulb adapter comprises:

a ring sized to fit within the first channel and between the interior member and the exterior member;

two or more holding arms extending from the ring that are adapted to cooperatively couple with a light bulb between the holding arms;

a longitudinal channel extends through the light fixture base between the first and second ends such that a wire is adapted to extend through light fixture and electrically connect with the light bulb secured via the light bulb adapted mounted to the light fixture base;

the second base housing comprising a quick connect system adapted to removably secure with a plurality of base supporting attachments.

2. The modular light fixture of claim 1, wherein the quick connect system comprises external pins disposed extending radially from the second base housing.

3. The modular light fixture of claim 2, wherein each of the plurality of base supporting attachments include slots sized to receive the external pins, such the desired base supporting attachment is removably coupled with the light fixture base.

4. The modular light fixture of claim 3, wherein the slots of each of the plurality of base supporting attachments are P-shaped channels and correspond to the external pins, wherein the base supporting attachments are secured to the light fixture base by positioning the external pins into a bowl portion of the P-shaped channels.

5. The modular light fixture of claim 4, wherein one base supporting attachment of the plurality of base supporting attachments is a hanging light base supporting attachment.

6. The modular light fixture of claim 5, wherein the hanging light base supporting attachment comprises a hook for suspending the modular light fixture.

7. The modular light fixture of claim 4, wherein one base supporting attachment of the plurality of base supporting attachments is a pivot elbow base supporting attachment, the pivot elbow base supporting attachment comprising:

a first member pivotally connected to a second member via a pin, wherein an angle formed between the first and second members;

an external pin disposed extending radially from the second member and a P-shaped channel disposed on the first member;

wherein a second base supporting attachment is adapted to the coupled to the external pin from the second member.

8. The modular light fixture of claim 4, wherein one base supporting attachment of the plurality of base supporting attachments is a quick connect riser base supporting attachment.

9. The modular light fixture of claim 4, wherein one base supporting attachment of the plurality of base supporting attachments is a ground stake base supporting attachment, the ground stake base supporting attachment comprising a stake tip for penetrating a ground.

10. The modular light fixture of claim 4, wherein one base supporting attachment of the plurality of base supporting attachments is a slotted quick disconnect base supporting attachment, the slotted quick disconnect base supporting attachment comprising a threaded distal end.

11. The modular light fixture of claim 2, wherein the second base housing is coupled with a quick connect riser base supporting attachment which is in turn connected to a ground stake base supporting attachment comprising a stake tip for penetrating a ground.

12. The modular light fixture of claim 1, wherein the first base is cylindrical, and the first channel is annular.

13. The modular light fixture of claim 1, further comprising a light shroud adapted to fit over the first cylindrical base and secure via a light shroud retaining lip disposed on an exterior of the first cylindrical base.

14. The modular light fixture of claim 13, wherein the light shroud is directly engaged with the exterior of the first cylindrical base forming a continuous exterior side.

15. A modular light fixture, comprising:

a light fixture base comprising an annular ring extending at a first end and a cylindrical base extension at a second end;

the cylindrical base extension adapted to removably secure with a plurality of base supporting attachments;

wherein the annular ring forms an inner recess dimensioned to receive a light source therein;

a longitudinal channel extends through the base housing such that a wire is adapted to extend through cylindrical base extension and electrically connect with the light source secured to the light fixture base;

wherein the annular ring is adapted to removably secure to a shroud.

16. The modular light fixture of claim 15, further comprising the plurality of base supporting attachments, wherein the cylindrical base extension comprises a threaded fastener, the threaded fastener adapted to removably secure to the plurality of base supporting attachments, wherein the plurality of base supporting attachments is a hanging light base supporting attachment, a pivot elbow base supporting attachment, a quick connect riser base supporting attachment, a ground stake base supporting attachment, and a slotted quick disconnect base supporting attachment.

17. The modular light fixture of claim 16, wherein a threaded fastener of the annular ring and the cylindrical base extension are concentric about a same longitudinal axis.

18. The modular light fixture of claim 17, wherein the annular ring has a larger radius than the cylindrical base extension.

19. The modular light fixture of claim 18, wherein the threaded fasteners of the annular ring and the cylindrical base extension are disposed on an exterior side of the light fixture base.

20. The modular light fixture of claim 19, wherein the light fixture base comprises an annular channel disposed on the exterior side thereof, the annular channel configured to seat a light shroud weather seal therein, wherein the light shroud weather seal is adapted to seal an interior formed by the shroud.

* * * * *